US005878814A

United States Patent [19]

Breivik et al.

[11] Patent Number: 5,878,814

[45] Date of Patent: Mar. 9, 1999

[54] METHOD AND SYSTEM FOR OFFSHORE PRODUCTION OF LIQUEFIED NATURAL GAS

[75] Inventors: Kare Breivik, Tau; Arne Olav Fredheim, Trondheim; Pentti Paurola, Hafrsfjord, all of Norway

[73] Assignee: Den Norske Stats Oljeselskap A.S., Norway

[21] Appl. No.: 849,349

[22] PCT Filed: Dec. 8, 1995

[86] PCT No.: PCT/NO95/00228

§ 371 Date: Aug. 20, 1997

§ 102(e) Date: Aug. 20, 1997

[87] PCT Pub. No.: WO96/17766

PCT Pub. Date: Jun. 13, 1996

[30] Foreign Application Priority Data

Dec. 8, 1994 [NO] Norway ..... 944755

[51] Int. Cl.[6] ..... E21B 43/01; E21B 43/34

[52] U.S. Cl. ..... 166/267; 166/357

[58] Field of Search ..... 166/267, 357, 166/344, 350

[56] References Cited

U.S. PATENT DOCUMENTS

| | | | |
|---|---|---|---|
| 4,067,202 | 1/1978 | Reed | 405/224.2 |
| 4,433,940 | 2/1984 | Harrison . | |
| 4,632,603 | 12/1986 | Baugh . | |
| 4,826,354 | 5/1989 | Adorjan | 405/158 |
| 4,892,495 | 1/1990 | Svensen . | |
| 4,991,614 | 2/1991 | Hammel | 137/13 |
| 5,025,860 | 6/1991 | Mandrin | 166/267 |
| 5,431,589 | 7/1995 | Corona | 441/4 |

*Primary Examiner*—Frank S. Tsay
*Attorney, Agent, or Firm*—Banner & Witcoff, Ltd.

[57] ABSTRACT

A method and a system for offshore production of liquefied natural gas, wherein natural gas is supplied from an underground source (4) to a subsea production plant (1). The gas is transferred under a high pressure directly from the production plant (1) to an LNG tanker (6), the transfer taking place through a pipeline (5) surrounded by sea water and causing the temperature of the high pressure gas to be lowered to a desired low temperature. This gas is supplied to a conversion plant (12) provided on the LNG tanker (16) and arranged for converting at least a part of the gas to liquid form, and the liquefied gas is transferred to storage tanks (17) on board the vessel (6). When the storage tanks (17) on the LNG tanker (6) are filled up, the pipeline is disconnected from the LNG tanker and connected to another similar tanker, the pipeline being permanently connected to a submerged buoy (8) which is arranged for introduction and releasable securement in a submerged downwardly open receiving space (11) in the tanker (6), and which is provided with a swivel unit for transfer of gas under a high pressure.

8 Claims, 3 Drawing Sheets

METHOD AND SYSTEM FOR OFFSHORE PRODUCTION OF LIQUEFIED NATURAL GAS

FIELD OF THE INVENTION

The invention relates to a method for offshore production of liquefied natural gas, wherein natural gas is supplied from an underground source to a production plant, the gas being transferred under a high pressure from the production plant to a LNG tanker, the transfer taking place through a pipeline surrounded by sea water, and wherein the high pressure gas is supplied to a conversion plant provided on the LNG tanker and arranged to convert at least a part of the gas to liquefied form by expansion of the gas, and the so liquefied gas is transferred to storage tanks on board the tanker.

Further, the invention relates to a system for offshore production of liquefied natural gas, comprising a production plant to which natural gas is supplied from an underground source, and a pipeline surrounded by sea water for transfer of gas under a high pressure from the production plant to a LNG tanker, the LNG tanker comprising a plant for conversion of at least a part of the gas to liquefied form by expansion of the gas, and storage tanks for storage of liquefied gas on the tanker.

BACKGROUND OF THE INVENTION

A method and a system of the above-mentioned type are known from U.S. Pat. No. 5,025,860. In the known system, the natural gas is purified on a platform or a ship and is thereafter transferred in compressed and cooled form via a high-pressure line to a LNG tanker where the gas is converted to liquefied form by expansion. The liquefied gas is stored on the tanker at a pressure of approximately 1 bar, whereas non-liquefied residual gases are returned to the platform or ship via a return line. The high-pressure line and the return line, which extend through the sea between the platform/ship and the LNG tanker, at both ends are taken up from the sea so that the end portions of the lines extend up from the water surface through free air and at their ends are connected to respective treatment units on the platform/ship and the LNG tanker, respectively.

With this transfer arrangement the high-pressure line and the return line will be subjected to external influences of different kinds under the different operational conditions which may occur in practice. Difficult weather conditions with storms and high waves will place clear limitations on the system operation, as both security reasons and practical reasons will then render impossible disconnection of the lines from a LNG tanker having full loading tanks, and connection of the lines to another, empty LNG tanker. Under such weather conditions it will also present problems to keep the LNG tanker in position so that it does not turn or move and interferes with the lines. In addition, in arctic waters the lines may be subjected to collision with icebergs or ice floes floating on the water.

In offshore production of hydrocarbons (oil and gas) it is known to make use of production vessels which are based on the so-called STP technique (STP=Submerged Turret Production). In this technique there is used a submerged buoy of the type comprising a central bottom-anchored member communicating with the topical underground source through at least one flexible riser, and which is provided with a swivel unit for the transfer of fluid to a production installation on the vessel. On the central buoy member there is rotatably mounted an outer buoy member which is arranged for introduction and releasable securement in a submerged downwardly open receiving space at the bottom of the vessel, so that the vessel may turn about the anchored, central buoy member under the influence of wind, waves and water currents. For a further description of this technique reference may be made to e.g. Norwegian laying-open print No. 176 129.

Further, in offshore loading and unloading of hydrocarbons it is known to use a so-called STL buoy (STL= Submerged Turret Loading) which is based on the same principle as the STP buoy, but which has a simpler swivel means than the STP swivel which normally has several through-going passages or courses. For a further description of this buoy structure reference may e.g. be made to Norwegian laying-open print No. 175 419.

By means of the STL/STP technique there is achieved that one can carry out offshore loading/unloading as well as offshore production of hydrocarbons in practically all kinds of weather, as both connection and disconnection between ship and buoy can be carried out in a simple and quick manner, also under very difficult weather conditions with high waves. Further, the buoy can remain connected to the vessel in all kinds of weather, a quick disconnection being able to be carried out if a weather limitation should be exceeded.

Because of the substantial practical advantages involved in the STL/STP technique, it would be desirable to be able to make use of this technique also in connection with offshore production of liquefied natural gas. One could then construct a field installation for the production of LNG on a production vessel or a production platform, and transfer the liquefied gas to a LNG tanker via a transfer line and a STP buoy, as the LNG tanker then would be built for connection/disconnection of such a buoy. However, this is not feasible with the technique of today, since cryogenic transfer of LNG via a swivel, or also via conventional "loading arms", in practice is attended with hitherto unsolved problems in connection with freezing, clogging of passages etc. Such transfer is also attended with danger of unintentional spill of LNG on the sea, as this would be able to result in explosion-like evaporation ("rapid phase transition"), with a substantial destructive potential.

On this background it is an object of the invention to provide a method and a system for offshore production of LNG, wherein the above-mentioned weaknesses of the known system are avoided, and wherein one also avoids the mentioned problems attended with cryogenic medium transfer.

Another object of the invention is to provide a method and a system of the topical type which utilizes the STL/STP technique and the possibilities involved therein with respect to flexibility, safety and efficient utilization of the resources.

A further object of the invention is to provide a method and a system of the topical type which result in a relatively simple and cheap installation for conversion of natural gas to LNG.

BRIEF SUMMARY OF THE INVENTION

For the achievement of the above-mentioned objects there is provided a method of the introductorily stated type which, according to the invention, is characterized in that the gas is supplied directly from a subsea production plant to the pipeline at a relatively high temperature, and that the pipeline is made heat transferring and has a sufficiently long length that the gas during the transfer through the pipeline is cooled to a desired low temperature near the sea water temperature during heat exchange with the surrounding sea water, and that the pipeline, when the storage tanks on the LNG tanker are filled up, is disconnected from the LNG tanker and connected to another, similar tanker, the pipeline being permanently connected to a submerged buoy which is arranged for introduction and releasable securement in a submerged downwardly open receiving space in the tanker, and which is provided with a swivel unit for transfer of gas under a high pressure.

The above-mentioned objects are also achieved with a system of the introductorily stated type which, according to the invention, is characterized in that the production plant is a subsea production plant and the pipeline extends directly between the production plant and the LNG tanker, the pipeline having a sufficient length that the gas during the transfer is cooled to a desired low temperature, and that the pipeline at the end which is remote from the production plant, is permanently connected to at least one submerged buoy which is arranged for introduction and releasable securement in a submerged downwardly open receiving space at the bottom of the LNG tanker, and which is provided with a swivel unit for transfer of gas under a high pressure.

By means of the method and the system according to the invention there is obtained a number of substantial structural and operational advantages. The utilization of the STL/STP concept entails that it is only necessary with minor hull modifications in order to construct the necessary receiving space for reception of the topical buoys. The hull of the LNG tanker can be designed in an optimal manner, so that vessels having a good seaworthiness can be obtained. The system will be far less subject to collisions and far less subject to external weather influences, as compared to the introductorily mentioned, known system. Further, one achieves the operational advantage that the LNG tanker can turn about the buoy under the influence of wind, waves and water currents. The pipeline which is connected to the buoy, can be connected and disconnected from the LNG tanker in a simple, quick and safe manner, also under very difficult weather conditions. The pipeline may be combined or integrated with a gas return line, and possibly also with a line for transfer of electrical power, in which case these lines then will be connected to special courses or transfer means in the buoy. This makes possible a simple transfer of return gas and/or possible electrical surplus power from the LNG tanker to the field installation.

In the method according to the invention the natural gas is transferred from the subsea production plant in a condition which is suitable for simplified and economic conversion of the gas to liquefied form in the conversion plant on the LNG tanker. In general, one makes use of the fact that the gas emerges from the source or reservoir at a relatively high pressure, e.g. approximately 300 bars, and the gas—together with possible condensate—is then transferred in compressed form directly to the conversion plant on the LNG tanker. If the gas pressure at the wellhead is not sufficiently high, it may be increased to the desired level, usually in the range 250–400 bars, by means of a subsea compressor. The gas temperature at the wellhead typically may be approximately 90° C. During the transport through the pipeline to the STP buoy the gas is cooled to a temperature approaching the sea water temperature, at the same time as the gas pressure generally is maintained.

The invention will be further described below in connection with exemplary embodiments with reference to the drawings.

DETAILED DESCRIPTION OF THE INVENTION

Figure 1:
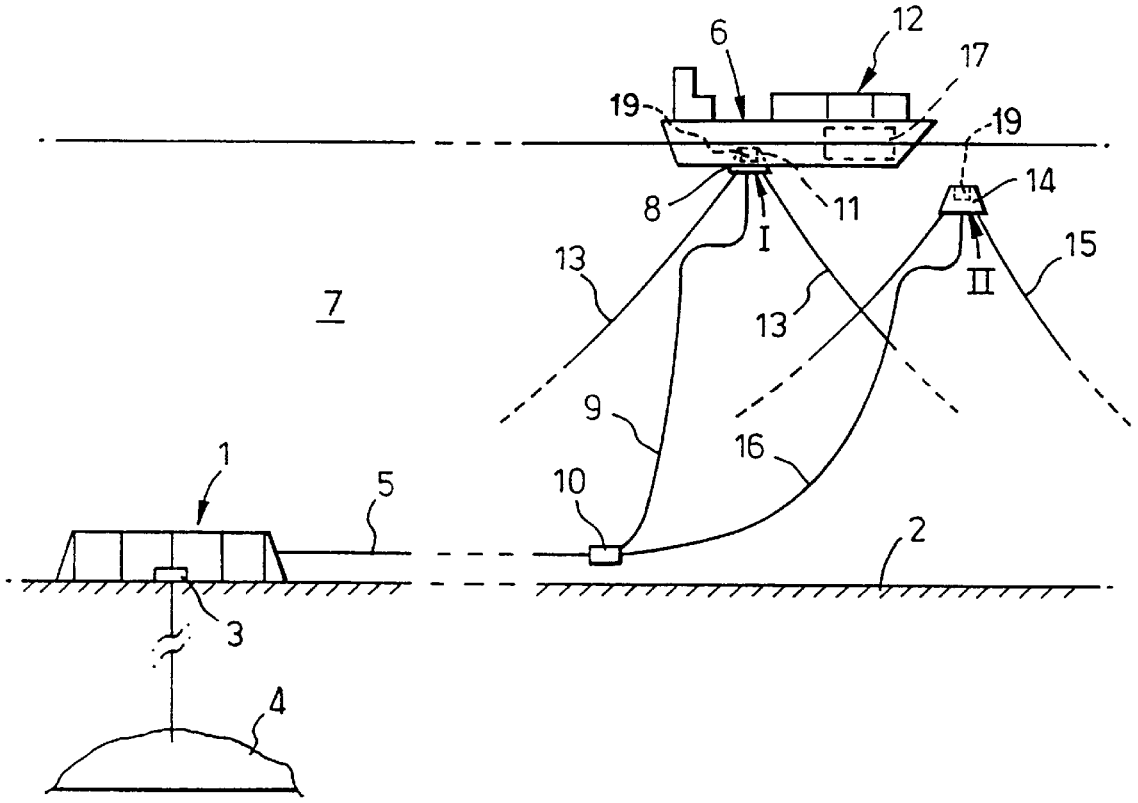
FIG. 1 is a schematic view showing the fundamental construction of a system according to the invention.

As schematically shown in FIG. 1, a conventional subsea production plant 1 is installed at the sea bed 2 in connection with a wellhead 3 communicating with an underground source 4 for natural gas.

The production plant 1 is connected to a pipeline 5 which is arranged for transfer of gas under a high pressure from the production plant to a floating transport vessel 6 in the form of a LNG tanker, the gas transferred through the pipeline being in heat-exchanging connection with the surrounding body of water (sea water) 7. The end of the pipeline 5 which is remote from the production plant, is permanently connected to a STP buoy 8 of the introductorily stated type. As shown, the pipeline is connected to the buoy 8 via a flexible pipe section or riser 9 extending up to the buoy from a branch point 10.

The buoy 8 is introduced into and releasably secured in a submerged downwardly open receiving space 11 at the bottom of the vessel 6. As mentioned above, the buoy comprises a swivel unit 19 forming a flow connection between the pipe section 9 and a gas conversion plant 12 on the vessel 6. The central member of the buoy is anchored to the sea bed 2 by means of a suitable anchoring system comprising a number of anchor lines 13. For a further description of the buoy and swivel structure reference is made to the aforementioned Norwegian laying-open print No. 176 129.

In addition to the buoy 8 (buoy I) there is also provided an additional submerged buoy 14 (buoy II) which is anchored to the sea bed by means of anchor lines 15. The pipeline 5 is also permanently connected to this buoy via a branch pipeline in the form of a flexible riser 16 which is connected to the pipeline 5 at the branch point 10. The purpose of the arrangement of two buoys will be further described later.

The pipeline 5 may extend over substantial length in the sea, as a suitable distance between the production plant 1 and the buoys I and II in practice may be 1–2 km.

As mentioned, an installation or plant 12 for conversion of the compressed natural gas to liquid form is arranged on the vessel or LNG tanker 6. Liquefied gas which is produced in the plant, is stored in tanks 17 on board the vessel. Such as also mentioned, the natural gas is supplied under a high pressure and in cooled form to the conversion plant 12, and this is therefore mainly based on expansion of the gas in order to convert at least a part thereof to liquid form. In combination with at least one expansion step there is used one or more cooling steps which are located either before or after the expansion step or steps. The structural design of the plant partly will be dependent on the nature of the topical gas, and partly on the results which are wanted to be achieved, i.a. with respect to efficiency, utilization of surplus energy, residual gas, etc. which is produced during the process.

As shown in FIG. 1, the LNG tanker 6 is connected to the loading buoy 8 (buoy I), whereas the additional buoy 14 (buoy II) is submerged, in anticipation of connection to another LNG tanker. In practice it may be envisaged that the conversion plant 12 can produce approximately 8000 tons of LNG per day. With a vessel size of 80 000 tons the vessel will then be connected to the buoy I for 10 days before its storage tanks 17 are full. When the tanks are full, the vessel leaves the buoy I, and the production continuous via the buoy II where another LNG tanker is then connected. The finished loaded vessel transports its load to a receiving terminal. Based on normal transport distances and said loading time, for example four LNG tankers may be connected to the shown arrangement of two buoys I and II, to thereby achieve operation with "direct shuttle loading" (DSL) without any interruption in the production.

Even if one can achieve direct shuttle loading with the shown arrangement, continuous off-take of gas is not always an absolute presupposition, so that a LNG tanker does not have to be continuously connected to one of the loading buoys. Thus, the LNG tanker may leave the field/buoy for at least shorter periods (some days) without this having negative consequences.

Two embodiments of the conversion plant 12 will be described below with reference to FIGS. 2 and 3.

Figure 2:
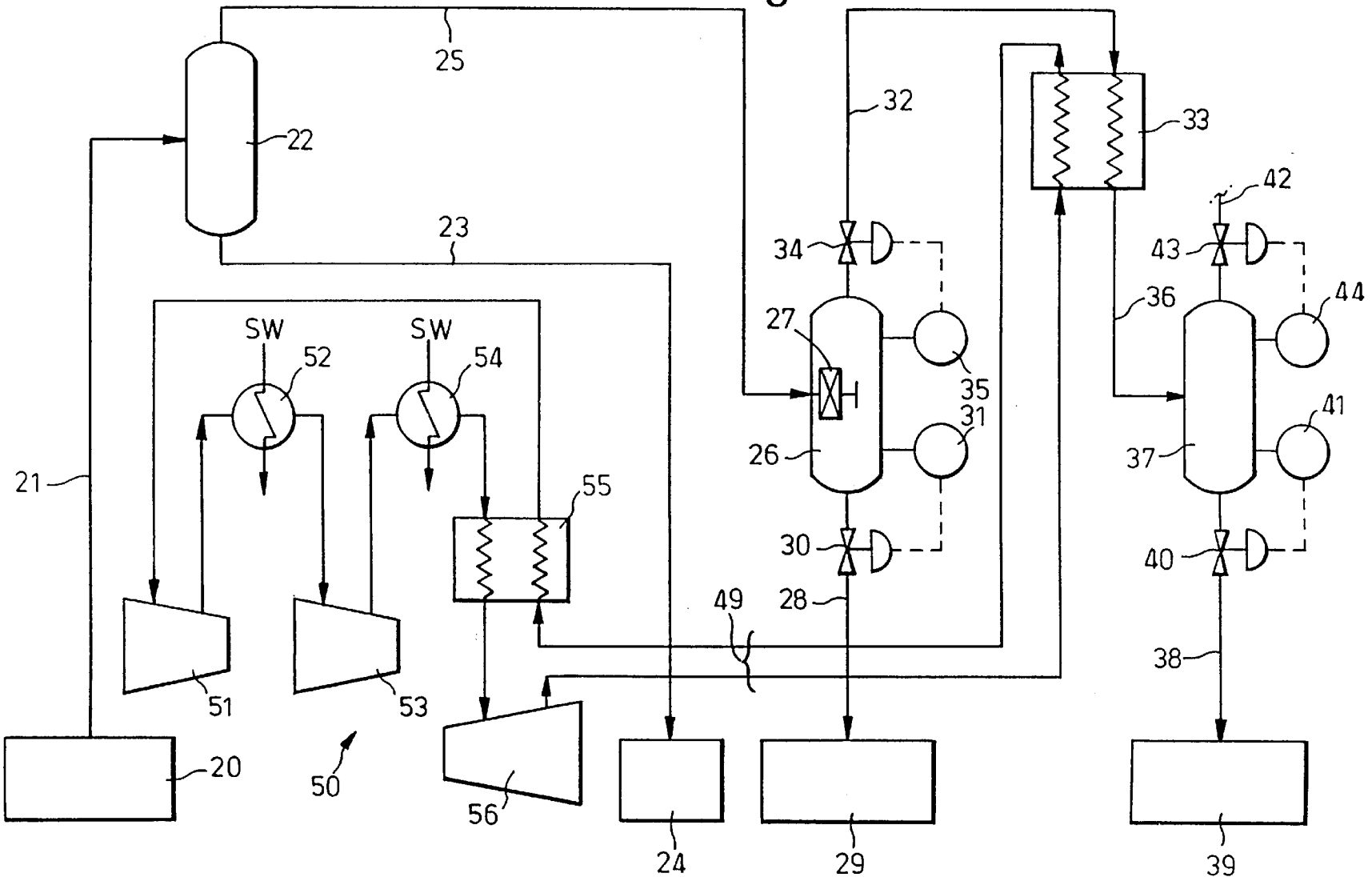
FIG. 2 shows a block diagram of a first embodiment of a plant for conversion of compressed natural gas on the transport vessel.

In the embodiment in FIG. 2 a well flow arrives in the form of gas and possible condensate from the production plant 1 to the conversion plant 12 via the swivel unit of the STP buoy 8 which is designated 20 in FIG. 2. The well flow arrives e.g. with a pressure of approximately 350 bars and a temperature of approximately 5° C. From the swivel 20 the well flow is supplied through a pipeline 21 to a liquid separator 22 (a so-called knock-out drum) in which liquid (condensate) and solid particles are separated and transferred through a pipeline 23 to a container 24. From the liquid separator the gas is conveyed through a pipeline 25 and expanded directly into a container 26 via a valve 27, more specifically a so-called Joule-Thomson valve. By expanding the gas to a low pressure, the temperature is simultaneously lowered to a low level, and a substantial part of the gas thereby is converted to liquefied gas (LNG) of so-called heavy type. As an alternative to the shown expansion step with an expansion valve, there may be used an isentropic expansion turbine (turbo expander). Possibly, several such expansion steps may be used.

The product container 26 is connected through a pipeline 28 to a tank 29 for storage of heavy LNG. In the pipeline 28 there is connected a level control valve 30 which is controlled by level sensor 31.

An additional pipeline 32 which is connected to the top of the container 26, conveys the gas which has "flashed off" during the expansion process, to a low-pressure heat exchanger unit 33 for further cooling of this gas. A pressure-controlled valve 34 which is controlled by a pressure control unit 35, is connected in the pipeline 32. The heat exchanger 33 may be a so-called plate-rib heat exchanger in which the used cooling medium may be nitrogen or a mixture of nitrogen and methane. In the heat exchanger most of the content of the gas of hydrocarbons is condensed to liquid.

The heat exchanger 33 is connected through a pipeline 36 to an additional product container 37 which is connected through a pipeline 38 to a tank 39 for storage of the liquefied gas from the heat exchanger unit. The temperature on this point of the plant is lowered to a value of approximately −163° C., and the pressure may be close to 1 bar. In the pipeline 38 there is connected a level control valve 40 which is controlled by a level sensor 41. To the top of the container 37 there is connected an additional pipeline 42 for discharge of residual gas from the container. This gas for example may be used as a fuel gas which may be utilized on board the vessel 6, e.g. for operation of the propulsion machinery thereof. Also in the line 42 there is connected a pressure-control valve 43 which is controlled by a pressure control unit 44.

As mentioned above, the utilized cooling medium in the heat exchanger 33 may be e.g. nitrogen. This cooling medium circulates in a cooling loop 49 forming part of a cryogenic cooling package 50 of a commercially available type, e.g. a unit of the type used in plants for the production of liquid oxygen. The cooling loop is shown to comprise a low pressure compressor 51 which is connected to a condenser 52, and a subsequent high pressure compressor 53 which is connected to a condenser 54, the condenser 54 being connected to a heat exchanger 55 for heat exchange of the cooling medium in the loop 59. Thus, the heat exchanger 55 contains a first branch leading from the condenser 54 to a cooling expander 56 of which the output is connected through the cooling loop 49 to the heat exchanger 33, and a second branch connecting the cooling loop 49 to the input of the low pressure compressor 51. As a cooling medium in the condensers 52 and 54 there may be used e.g. sea water (SW).

Figure 3:
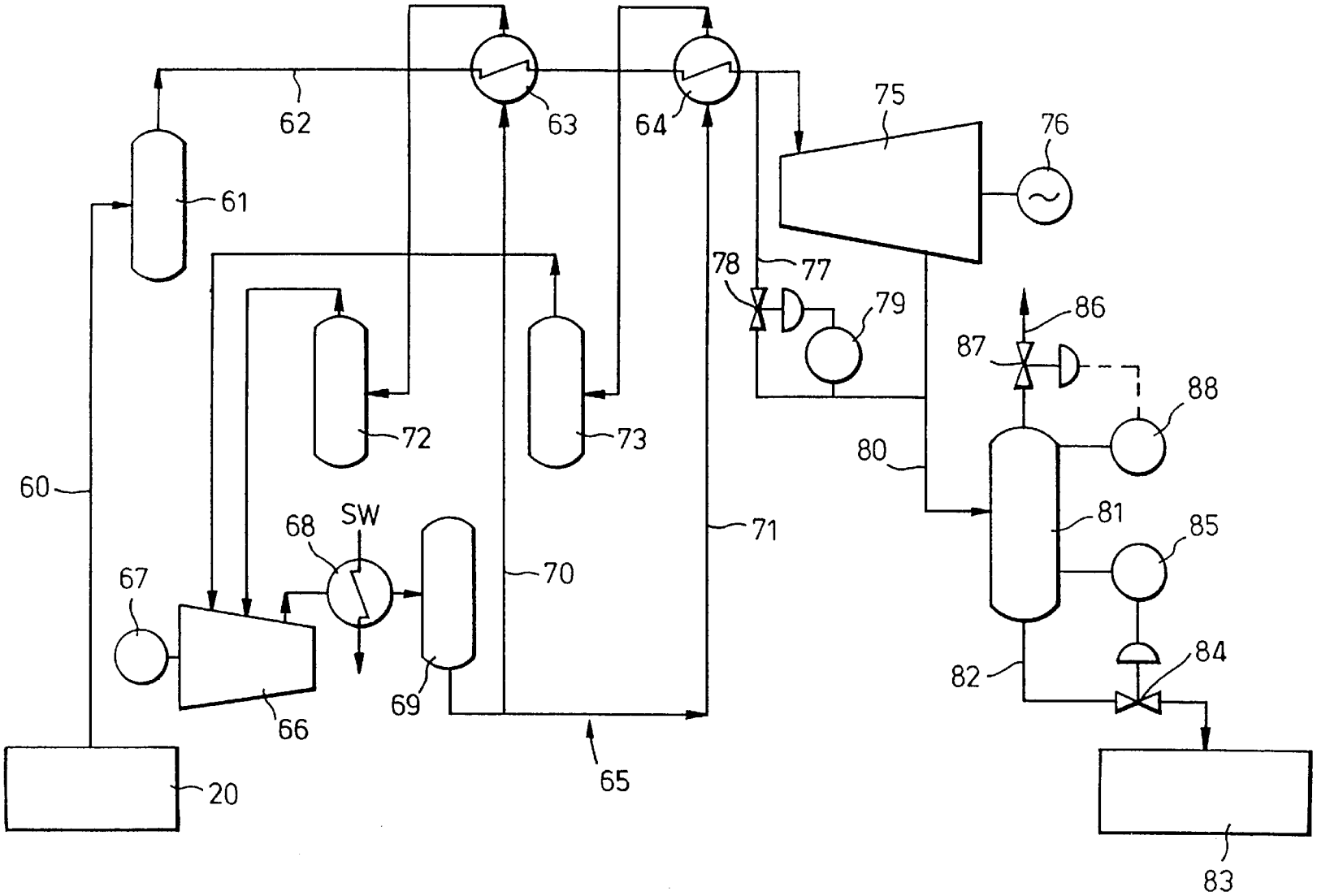
FIG. 3 shows a block diagram of a second embodiment of such a conversion plant.

Also in the embodiment shown in FIG. 3, the swivel unit of the STP buoy 8 is designated 20, and the well flow is presupposed to arrive at the conversion plant 12 with a pressure of about 350 bars and a temperature of about 4° C. From the swivel unit the gas is transferred through a pipeline 60 to a liquid separator 61 for separation of condensed liquid and solid particles. In this embodiment of the conversion plant the gas goes through a precooling before it is subjected to cooling by means of expansion. Thus, the gas from the liquid separator 61 is transported through a pipeline 62 to a pair of serially connected condensers 63 and 64 in which the temperature of the gas is lowered to about −35° C.

The condensers 63 and 64 are cooled by means of a cooling medium circulating in a two-step cooling loop 65 using propane as a cooling medium. As shown, the cooling loop comprises a compressor 66 which is driven by a generator 67 and is connected via a condenser 68 to a liquid separator 69. The condenser is cooled by means of sea water (SW).

To the output of the liquid separator 69 there are connected a pair of pipelines 70 and 72 which are connected to a respective one of the two condensers 63 and 64, and these pipelines 70, 71 are connected via the condensers to a respective one of two additional liquid separators 72, 73 the outputs of which are connected to respective inputs of the compressor 66.

The cooled gas is supplied to an isentropic expansion turbine 75 in which the gas is expanded from high pressure to low pressure and thereby is further cooled to such a low temperature that most of the gas is converted to liquid gas. The temperature here may be approximately −164° C.

An electrical generator 76 for the production of electrical power is associated with the expansion turbine 75. Further, the expansion turbine is bypassed by a bypass line 77 having a Joule-Thomson valve 78 which is influenced by a pressure-sensitive control means 79.

The expansion turbine 75 is connected through a line 70 to a product container 81 for the liquefied gas from the expansion turbine 75. From the container 81 a pipeline 82 leads to a tank 83 for storage of the produced LNG. The pressure here may be approximately 1,1 atmospheres, and the temperature may be approximately −163° C. In the pipeline 82 there is connected a level controlled valve 84 which is controlled by a level sensor 85.

To the top of the container 81 there is connected an additional pipeline 86 for discharge of residual gas from the container. This gas may be used in a similar manner to that stated in connection with the embodiment according FIG. 2. Also in the line 86 there is connected a pressure-controlled valve 87 which is controlled by a pressure control unit 88.

In the embodiments according to FIGS. 2 and 3 there is stated that the pressure in said expansion steps is reduced to a level close to 1 bar. However, it may be convenient to convert the gas to liquid form at a higher pressure, e.g. in the range 10–50 bars, as the temperature then does not need to be reduced to such a low level as stated above, viz. around −163° C. This may be economically advantageous, since an additional temperature lowering in the range down towards said temperature is relatively expensive. With such a conversion under a high pressure, the liquefied gas will also be stored under the topical higher pressure.

We claim:

1. A system for offshore production of liquefied natural gas, comprising a production plant to which natural gas is supplied from an underground source; a pipeline surrounded by sea water for transferring gas under a high pressure from the production plant to a LNG tanker, the LNG tanker comprising a plant for conversion of at least a part of the gas to a liquefied form by expansion of the gas and storage tanks for storage of liquefied gas on the tanker; wherein the production plant is a subsea production plant and the pipeline extends directly between the production plant and the LNG tanker, the pipeline having a sufficient length so that the gas is cooled to a desired low temperature during its transfer from the production plant to the LNG tanker; and wherein the pipeline includes an end which is remote from the production plant, said end being permanently connected to at least one submerged buoy which is arranged for introduction and releasable securement in a submerged downwardly open receiving space at the bottom of the LNG tanker, and which is provided with a swivel unit for transfer of gas under a high pressure.

2. A system according to claim 1, wherein the pipeline is also permanently connected to a second submerged buoy; and said pipeline being connected to said submerged buoys via respective flexible risers.

3. A system according to claims 1 or 2, wherein the conversion plant comprises a container in which a part of the gas is converted to a liquid condition at a first reduced temperature, and a heat exchanger for performing a subsequent cooling step in which an additional part of the gas is converted to a liquid condition at a second further reduced temperature.

4. A system according to claim 3, wherein the container comprises an expansion container having a valve arranged therein, the gas being expanded in the container by discharge from the valve.

5. A system according to claims 1 or 2, wherein the conversion plant comprises at least one precooling condenser, for lowering of the gas temperature to a first reduced temperature, and a device in which a substantial part of the gas is converted directly to a liquid condition at a second further reduced temperature and at a pressure close to atmospheric pressure.

6. A system according to claim 5, wherein the device comprises a turbo expander.

7. A method for offshore production of liquefied natural gas comprising the steps of:

a) supplying a natural gas from an underground source to a subsea production plant;

b) providing and securing a pipeline formed of a material capable of heat transfer between said production plant and a submerged buoy provided with a swivel unit for transferring gas under high pressure, said buoy being capable of being introduced and releasably secured in a submerged downwardly open receiving space in an LNG tanker;

c) securing said buoy to said LNG tanker;

d) transferring said gas under a high pressure from the production plant to the LNG tanker through the pipeline surrounded by sea water, wherein the transferring step includes the steps of:

(i) supplying said gas directly from the production plant to the pipeline at a relatively high temperature;

ii) cooling said gas in said pipeline to a desired low temperature near the temperature of the sea water by heat exchange with the sea water surrounding the pipeline; and iii) supplying the gas to a conversion plant provided on the LNG tanker;

e) expanding and converting at least a portion of the gas within the conversion plant to a liquefied form;

f) transferring the liquefied gas to storage tanks on board the LNG tanker; and g) disconnecting the pipeline from the LNG tanker when the storage tanks on the tanker are filled.

8. A method according to claim 7, wherein the gas is transferred to the tanker at a pressure of at least 250 bars.

* * * * *